US007028494B2

(12) United States Patent
Pondicq-Cassou et al.

(10) Patent No.: US 7,028,494 B2
(45) Date of Patent: Apr. 18, 2006

(54) DEFROSTING METHODOLOGY FOR HEAT PUMP WATER HEATING SYSTEM

(75) Inventors: Nicolas Pondicq-Cassou, Lyons (FR); Jean-Philippe Goux, Toussieu (FR); Yu Chen, East Hartford, CT (US); Julio Concha, Rocky Hill, CT (US); Tobias Sienel, Manchester, CT (US); Sylvain Douzet, Beynost (FR)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/646,253

(22) Filed: Aug. 22, 2003

(65) Prior Publication Data

US 2005/0039473 A1 Feb. 24, 2005

(51) Int. Cl.
*F25D 21/06* (2006.01)
*F25B 41/00* (2006.01)
*F25B 49/00* (2006.01)

(52) U.S. Cl. ..... 62/196.4; 62/151; 62/156

(58) Field of Classification Search ..... 62/151, 62/196.4, 196.3, 156, 238.6, 155, 227
See application file for complete search history.

(56) References Cited

U.S. PATENT DOCUMENTS

| | | | | |
|---|---|---|---|---|
| 2,954,681 | A | 10/1960 | McCormack | |
| 3,188,829 | A | 6/1965 | Siewert et al. | |
| 3,332,251 | A | 7/1967 | Watkins | |
| 3,389,576 | A * | 6/1968 | Mauer | 62/196.4 |
| 4,770,000 | A * | 9/1988 | Kuroda et al. | 62/156 |
| 5,575,158 | A * | 11/1996 | Vogel | 62/196.4 |
| 6,418,737 | B1 | 7/2002 | Kuroki et al. | |
| 6,467,288 | B1 | 10/2002 | Kuroki et al. | |
| 2002/0095944 | A1* | 7/2002 | Stensrud et al. | 62/352 |
| 2004/0020230 | A1* | 2/2004 | Kuwabara et al. | 62/238.6 |
| 2004/0103685 | A1 | 6/2004 | Ohta et al. | |
| 2004/0187514 | A1* | 9/2004 | Franck et al. | 62/352 |

FOREIGN PATENT DOCUMENTS

| | | |
|---|---|---|
| DE | 12 31 729 | 1/1967 |
| DE | 32 27 604 | 2/1983 |
| DE | 35 01 789 | 9/1986 |
| DE | 36 09 304 | 10/1986 |
| EP | 0 161 338 | 11/1985 |
| GB | 887 884 | 1/1962 |
| JP | 58179764 | 10/1983 |
| JP | 2002310519 | 10/2002 |
| JP | 2003056907 | 2/2003 |
| JP | 2003130560 | 5/2003 |

(Continued)

OTHER PUBLICATIONS

International Search Report, Nov. 23, 2004.

*Primary Examiner*—Chen Wen Jiang
(74) *Attorney, Agent, or Firm*—Carlson, Gaskey & Olds

(57) ABSTRACT

Refrigerant is circulated through a vapor compression system including a compressor, a gas cooler, an expansion device, and an evaporator. When a sensor detects that frozen water droplets form on the evaporator, a valve positioned between the discharge of the compression and inlet of expansion device is opened. Refrigerant from the discharge of the compressor bypasses the gas cooler and enters the inlet of the expansion device. The high temperature refrigerant melts the frost on the evaporator. As the frost melts, the passage of the evaporator is opened to allow air to flow through the evaporator.

21 Claims, 6 Drawing Sheets

FOREIGN PATENT DOCUMENTS

| | | | |
|---|---|---|---|
| JP | 2003139392 | | 5/2003 |
| JP | 2003139405 | | 5/2003 |
| JP | 2003 185306 | | 7/2003 |
| JP | 2003222391 A | * | 8/2003 |
| WO | WO 02/18854 | | 3/2002 |
| WO | WO 02/188854 | | 3/2002 |
| WO | WO 03/042606 | | 5/2003 |
| WO | WO 03/064935 | | 7/2003 |
| WO | WO 03/064942 | | 7/2003 |
| WO | WO 03/064193 | | 8/2003 |

* cited by examiner

DEFROSTING METHODOLOGY FOR HEAT PUMP WATER HEATING SYSTEM

BACKGROUND OF THE INVENTION

The present invention relates generally to a water heating system including a valve located between the compressor outlet and the expansion device inlet to which is utilized to defrost passages in the evaporator.

Chlorine containing refrigerants have been phased out in most of the world due to their ozone destroying potential. Hydrofluoro carbons (HFCs) have been used as replacement refrigerants, but these refrigerants still have high global warming potential. "Natural" refrigerants, such as carbon dioxide and propane, have been proposed as replacement fluids. Unfortunately, there are problems with the use of many of these fluids as well. Carbon dioxide has a low critical point, which causes most air conditioning systems utilizing carbon dioxide to run partially above the critical point, or to run transcritical, under most conditions. The pressure of any subcritical fluid is a function of temperature under saturated conditions (when both liquid and vapor are present). However, when the temperature of the fluid is higher than the critical temperature (supercritical), the pressure becomes a function of the density of the fluid.

In a transcritical vapor compression system, the refrigerant is compressed to a high pressure in the compressor. As the refrigerant enters the gas cooler, heat is removed from the high pressure refrigerant. The heat is transferred to a fluid medium in a heat sink, such as water. The fluid medium is pumped through the gas cooler by a water pump. Next, after passing through an expansion device, the refrigerant is expanded to a low pressure. The refrigerant then passes through an evaporator and accepts heat from outdoor air. The refrigerant then re-enters the compressor completing the cycle.

If the surface temperature of the evaporator is below the dew-point temperature of the moist outdoor air, water droplets condense onto the evaporator fins. When the surface temperature of the evaporator is below freezing, the water droplets can freeze. Frost crystals grow from the frozen droplets and block the passage of air through the evaporator. The blockage increases the pressure drop through the evaporator, reducing the airflow through the evaporator, degrading heat pump performance, and reducing heating capacity.

In the prior art, the evaporator has been defrosted by deactivating the water pump in the gas cooler. The hot refrigerant from the compressor flows through the gas cooler without rejecting heat to the fluid in the gas cooler. The hot refrigerant is expanded and flows through the evaporator to defrost the evaporator. A drawback to this prior art system is that immediately after the water pump is deactivated, the gas cooler is still cold from the fluid. Therefore, the refrigerant must flow through the gas cooler while the water pump is off to warm the gas cooler. Once the gas cooler is warmed, the opening of the expansion device is enlarged to provide the warmed refrigerant to the evaporator. This system also incurs a greater pressure drop from the exit of the compressor to the inlet of the expansion device as the refrigerant must flow the long path through the gas cooler. This also requires that the opening degree of the expansion device be increased.

Hence, there is a need in the art for an improved defrosting methodology that overcomes these problems of the prior art.

SUMMARY OF THE INVENTION

A transcritical vapor compression system includes a compressor, a gas cooler, an expansion device, and an evaporator. Refrigerant is circulated though the closed circuit system. Preferably, carbon dioxide is used as the refrigerant. As carbon dioxide has a low critical point, systems utilizing carbon dioxide as a refrigerant usually require the vapor compression system to run transcritical.

After the refrigerant is compressed in the compressor, the refrigerant is cooled in a gas cooler. A water pump pumps water through the heat sink of the gas cooler. The cool water accepts heat from the refrigerant and exits the heat sink. The refrigerant then passes through the expansion device and is expanded to a low pressure. After expansion, the refrigerant flows through the evaporator and is heated by outdoor air, exiting the evaporator at a high enthalpy and low pressure.

A valve is positioned between the discharge of the compressor and the inlet of the expansion valve. When a sensor detects that frozen droplets begin to form on the passages of the evaporator, a control opens the valve to perform a defrost cycle. Hot refrigerant from the discharge of the compressor bypasses the first heat exchanger and enters the inlet of the expansion device. When the defrost cycle is initiated, the control turns the water pump off to stop of the flow of water into the heat sink of the gas cooler.

The high temperature refrigerant that bypasses the gas cooler enters the evaporator and melts the frost that forms on the evaporator passages. As the frost melts, the evaporator passages open to allow air to flow through the evaporator passages.

These and other features of the present invention will be best understood from the following specification and drawings.

BRIEF DESCRIPTION OF THE DRAWINGS

The various features and advantages of the invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
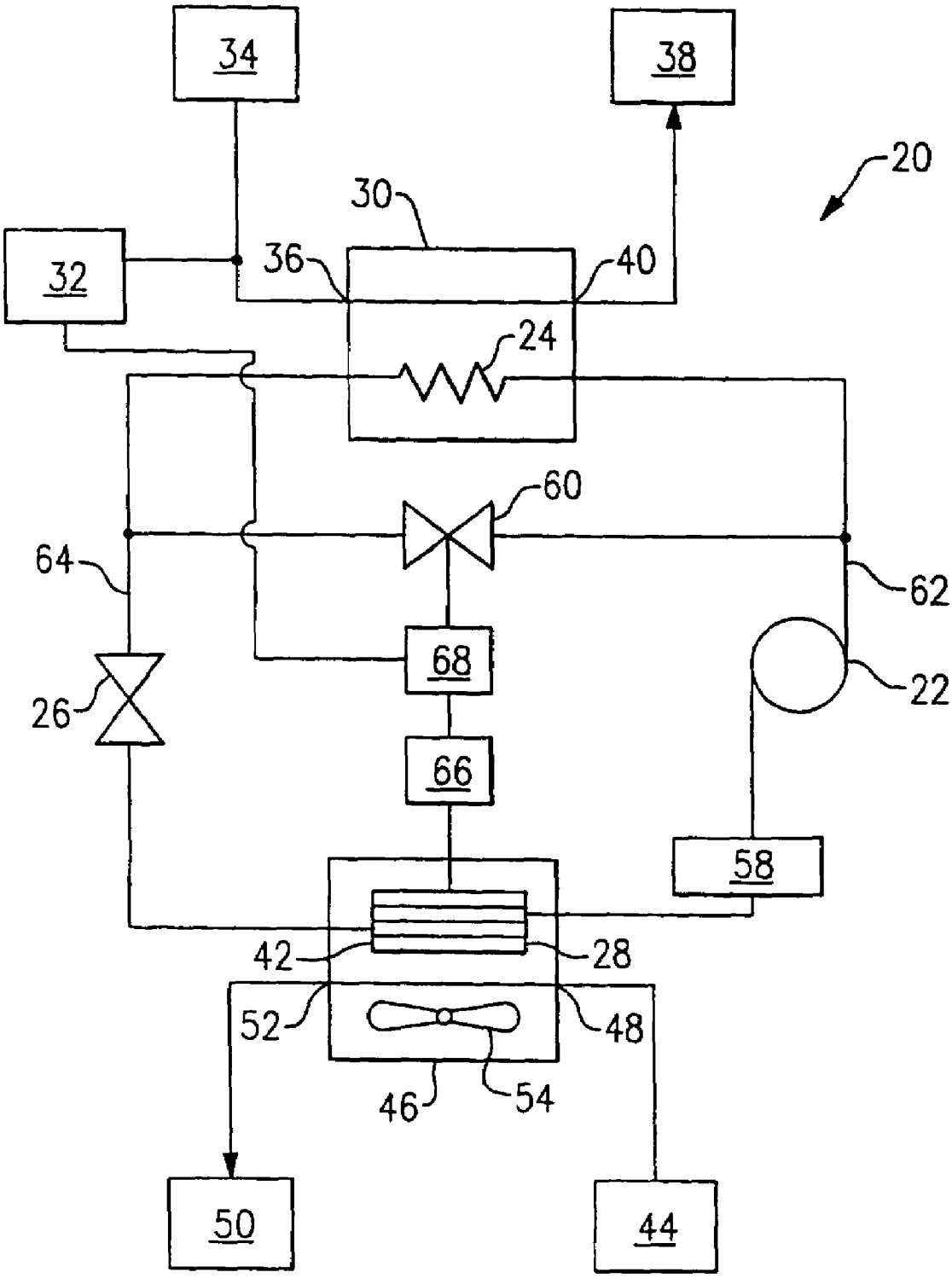
FIG. 1 schematically illustrates a diagram of a vapor compression system employing the valve of the present invention.

FIG. 1 illustrates a vapor compression system 20 including a compressor 22, a heat rejecting heat exchanger (a gas cooler in transcritical cycles) 24, an expansion device 26, and a heat accepting heat exchanger (an evaporator) 28.

Refrigerant circulates though the closed circuit system 20. Preferably, carbon dioxide is used as the refrigerant. Although carbon dioxide is described, other refrigerants may be used. Because carbon dioxide has a low critical point, systems utilizing carbon dioxide as a refrigerant usually require the vapor compression system 20 to run transcritical.

When operating in a water heating mode, the refrigerant exits the compressor 22 at high pressure and enthalpy. The refrigerant then flows through the gas cooler 24 and loses heat, exiting the gas cooler 24 at low enthalpy and high pressure. A fluid medium, such as water, flows through a heat sink 30 and exchanges heat with the refrigerant passing through the gas cooler 24. In the gas cooler 24, the refrigerant rejects heat to the fluid medium, which accepts heat. A water pump 32 pumps the fluid medium through the heat sink 30. The cooled fluid 34 enters the heat sink 30 at the heat sink inlet or return 36 and flows in a direction opposite to the direction of flow of the refrigerant. After exchanging heat with the refrigerant, the heated water 38 exits at the heat sink outlet or supply 40.

The refrigerant then passes through the expansion device 26, and the pressure drops. The expansion device 26 can be an electronic expansion valve (EXV) or other type of expansion device 26.

After expansion, the refrigerant flows through the passages 42 of the evaporator 28 and exits at a high enthalpy and low pressure. In the evaporator 28, the outdoor air rejects heat to the refrigerant which accepts the heat. Outdoor air 44 flows through a heat sink 46 and exchanges heat with the refrigerant passing through the evaporater 28. The outdoor air enters the heat sink 46 through the heat sink inlet or return 48 and flows in a direction opposite to or across the direction of flow of the refrigerant. After exchanging heat with the refrigerant, the cooled outdoor air 50 exits the heat sink 46 through the heat sink outlet or supply 52. The system 20 transfers heat from the low temperature energy reservoir (ambient air) to the high temperature energy sink (heated hot water). The transfer of energy is achieved with the aid of electrical energy input at the compressor 22. The temperature difference between the outdoor air and the refrigerant in the evaporator 28 drives the thermal energy transfer from the outdoor air to the refrigerant as the refrigerant passes through the evaporator 28. A fan 54 moves the outdoor air across the evaporator 28, maintaining the temperature difference and evaporating the refrigerant.

The system 20 can also include an accumulator 58. An accumulator 58 stores excess refrigerant from the system 20 to control the high pressure of the system 20, and therefore the coefficient of performance.

A valve 60 is positioned between the discharge 62 of the compressor 22 and the inlet 64 of the expansion valve 26. When a sensor 66 detects a condition that necessitates defrosting, a control 68 opens the valve 60 to perform a defrost cycle. Refrigerant from the discharge 62 of the compressor 22 bypasses the gas cooler 24 and enters the inlet 64 of the expansion device 26. The control 68 also turns the water pump 32 off to stop the flow of cooled fluid 34 into the gas cooler 24. In one example, defrosting is needed when frost accumulates on a coil of the evaporator 28.

When the sensor 66 detects that defrosting is no longer necessary, the control 68 closes the valve 60, allowing the system 20 to return to normal operation.

The valve 60 is sized such that the pressure drop through the valve 60 is much lower than the pressure drop through the gas cooler 24. Therefore, most of the refrigerant from the compressor 22 flows through the valve 60 and into the expansion device 26. The hot refrigerant throttled by the expansion device 26 is sent to the evaporator 28. The high temperature refrigerant flows through the passage 42 of the evaporator 28, heating the evaporator 28 and melting the frost on the evaporator 28. The expansion valve 26 is controlled during the defrost cycle to maximize the compressor 22 power and to increase the defrosting process.

Figure 2:
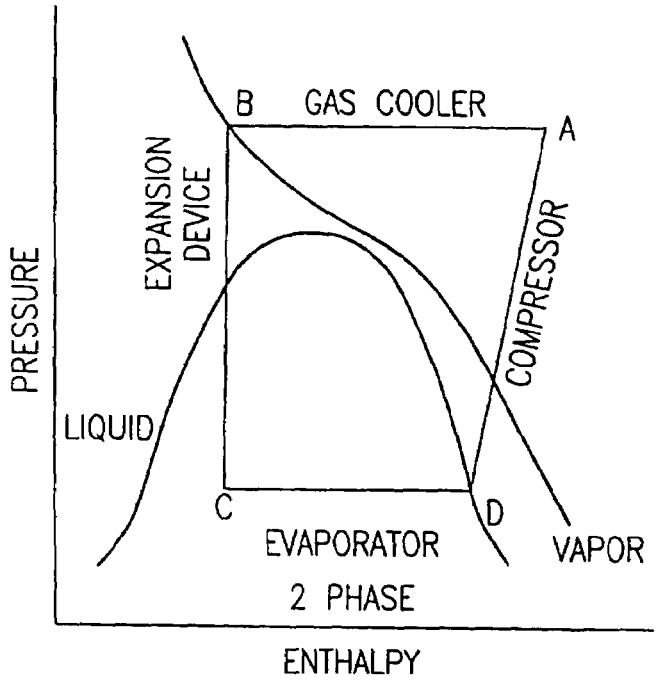
FIG. 2 schematically illustrates a thermodynamic diagram of a transcritical vapor compression system during normal operation.

FIG. 2 schematically illustrates a diagram of the vapor compression system 20 during normal operation. The refrigerant exits the compressor 22 at high pressure and enthalpy, shown by point A. As the refrigerant flows through the gas cooler 24 at high pressure, it loses heat and enthalpy to the fluid medium, exiting the gas cooler 24 with low enthalpy and high pressure, indicated as point B. As the refrigerant passes through the expansion valve 26, the pressure drops, shown by point C. After expansion, the refrigerant passes through the evaporator 28 and exchanges heat with the outdoor air, exiting at a high enthalpy and low pressure, represented by point D. After the refrigerant passes through the compressor 22, the refrigerant is again at high pressure and enthalpy, completing the cycle.

Figure 3:
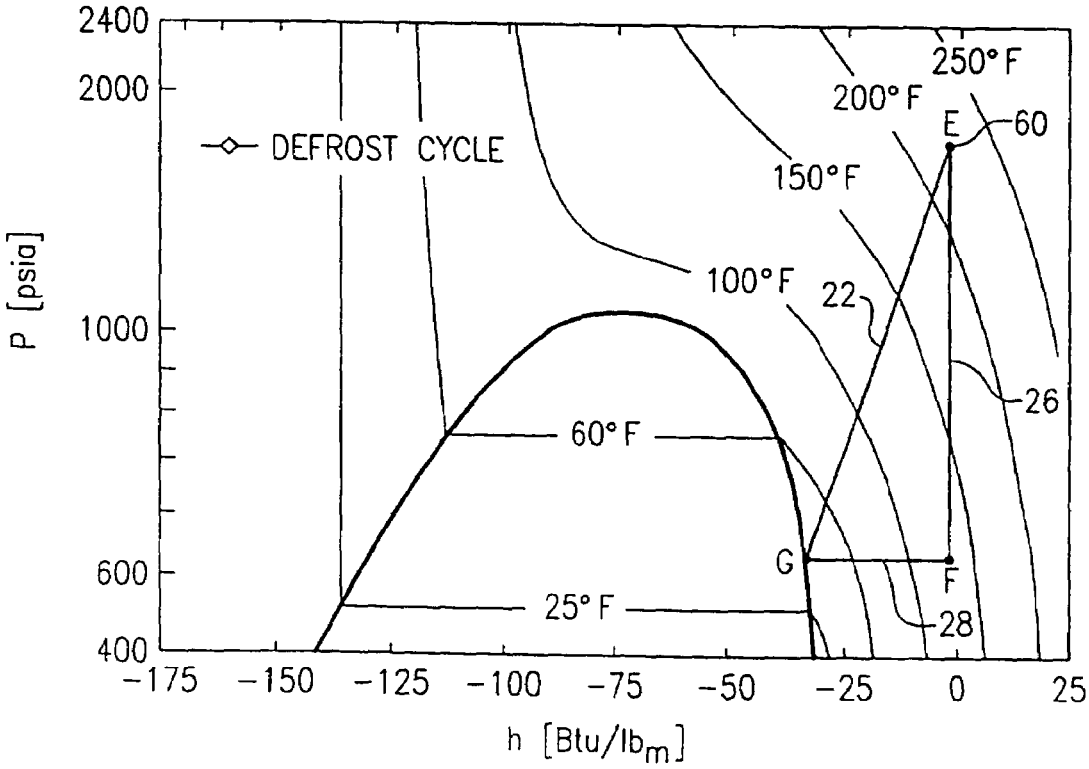
FIG. 3 schematically illustrates a thermodynamic diagram of the transcritical vapor compression system when the valve is open.

FIG. 3 schematically illustrates a thermodynamic diagram of the vapor compression system 20 in the defrost mode. The refrigerant flows through the compressor 22 and exits at high enthalpy and high pressure, shown as point E. When the valve 60 is opened, the refrigerant bypasses the gas cooler and flows through the valve 60. The refrigerant is then directed to the expansion device 26. The hot refrigerant is expanded to a low pressure by the expansion device 26, shown as point F. The hot refrigerant then flows through the evaporator 28. The hot refrigerant in the evaporator 28 rejects heat to the evaporator 28, melting the frost on the passages 42 of the evaporator 28. After passing through the evaporator 28, the refrigerant is at low enthalpy and low pressure, shown by point G. The refrigerant when re-enters the compressor 22, completing the cycle of the system 20.

Figure 4:
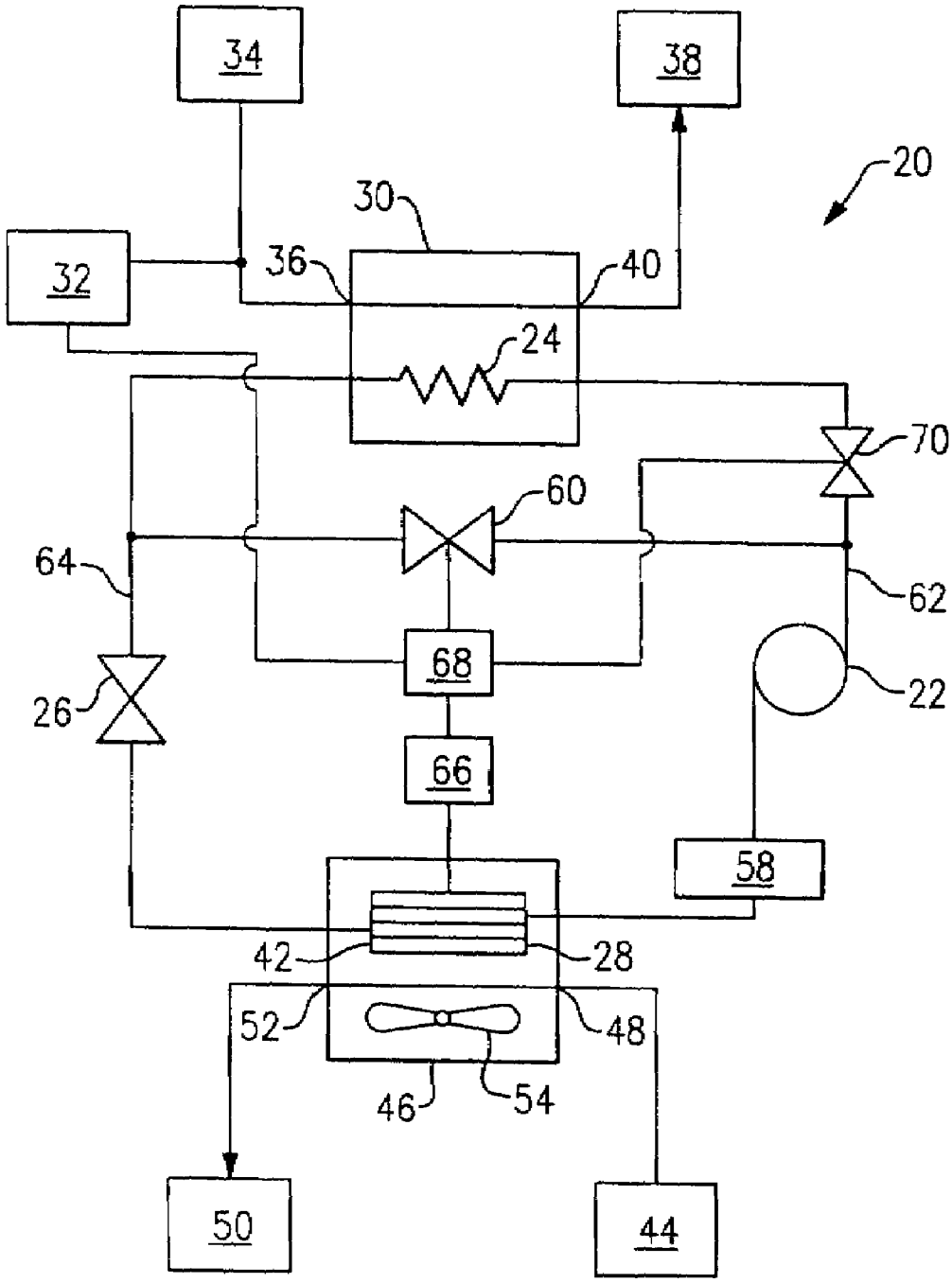
FIG. 4 schematically illustrates a second example vapor compression system of the present invention.

FIG. 4 schematically illustrates an alternate example of the system 20 of the present invention. The system 20 further includes a valve 70 positioned between the discharge 62 of the compressor 22 and the gas cooler 24. In one example, the valve 70 is a solenoid valve. The degree of opening or closing of the valve 70 is variable. When the sensor 66 detects a condition that necessitates defrosting, the control 68 opens the valve 60 and closes the valve 70, preventing refrigerant from the compressor 22 from entering the gas cooler 24. When the sensor 66 detects that frosting is no longer necessary, the control 68 closes the valve 60 and opens the valve 70, allowing refrigerant from the compressor 22 to enter the gas cooler 24.

Figure 5:
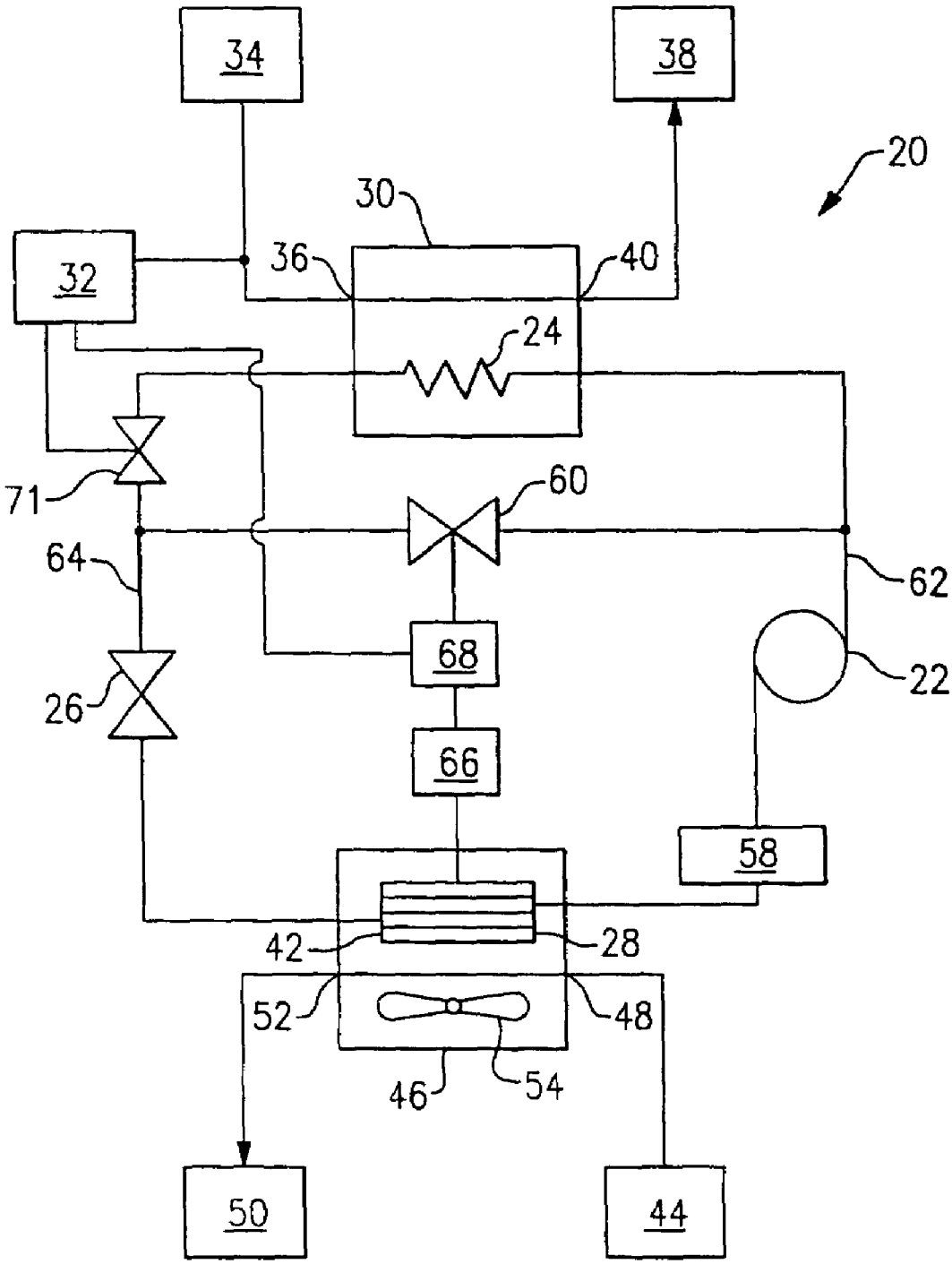
FIG. 5 schematically illustrates a third example vapor compression system of the present invention.

FIG. 5 schematically illustrates an alternate example of the system 20 of the present invention. The system 20 further includes a valve 71 positioned between the gas cooler 24 and the inlet 64 of the expansion device 26. When the sensor 66 detects a condition that necessitates defrosting, the control 68 opens the valve 60 and closes the valve 71, preventing refrigerant from the gas cooler 24 from entering the expansion device 26. When the sensor 66 detects that frosting is no longer necessary, the control 68 closes the valve 60 and opens the valve 71, allowing refrigerant from the gas cooler 24 to enter the expansion device 26.

Figure 6:
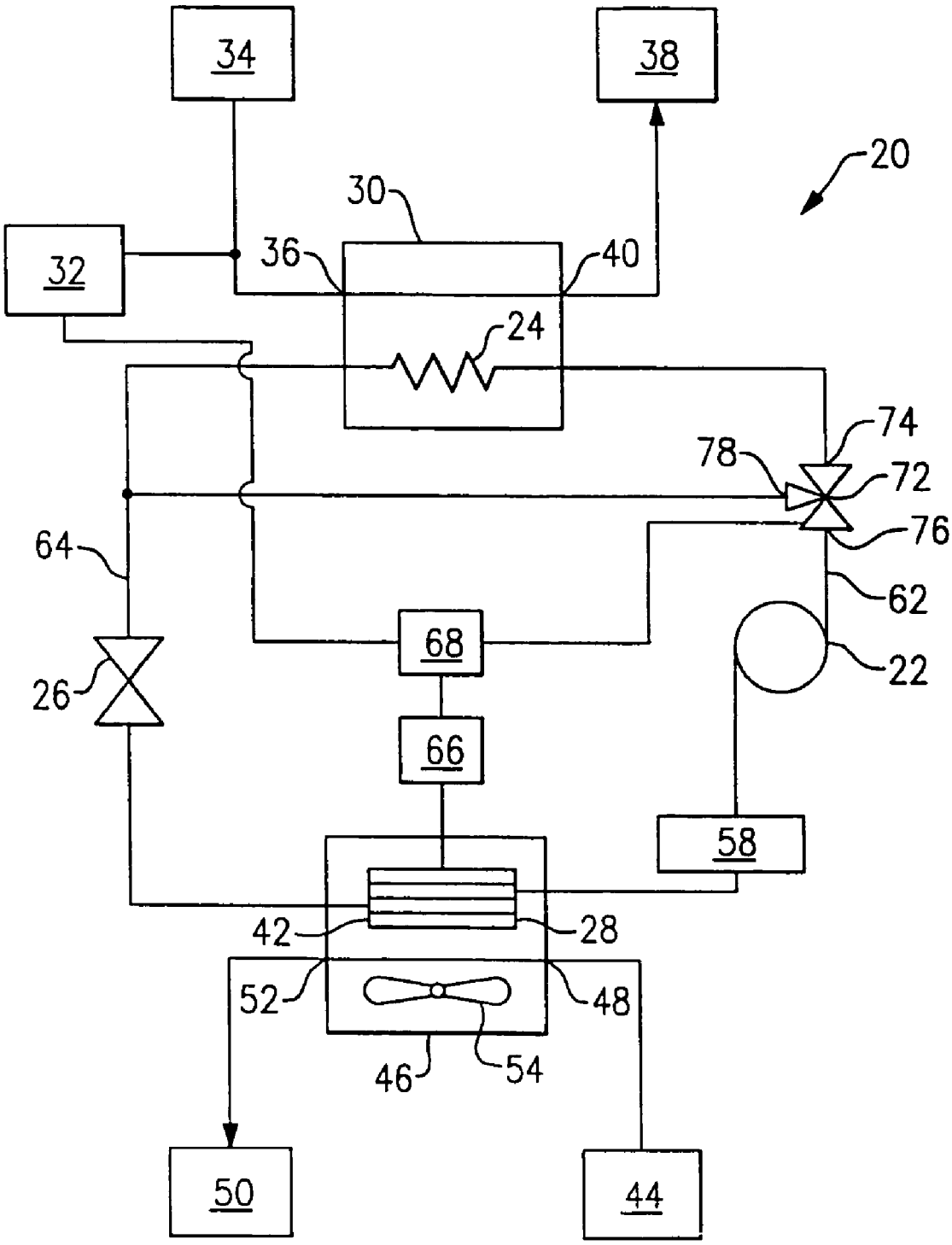
FIG. 6 schematically illustrates a fourth example vapor compression system of the present invention.

FIG. 6 schematically illustrates an alternate example of the system 20 of the present invention. The system 20 further includes a three-way valve 72 positioned between the discharge 62 of the compressor 22, the gas cooler 24, and the expansion device 26. The valve 70 includes a port 76 leading to the discharge 62 of the compressor 22, a port 74 leading to the gas cooler 24, and a port 78 leading to the inlet 64 of the expansion device 26. When the sensor 66 detects a condition that necessitates defrosting, the control 68 opens the ports 76 and 78 and closes the port 74, preventing refrigerant from the compressor 22 from entering the gas cooler 24. When the sensor 66 detects that frosting is no longer necessary, the control 68 closes the port 78 and opens the port 74, allowing refrigerant from the compressor 22 to enter the gas cooler 24.

Figure 7:
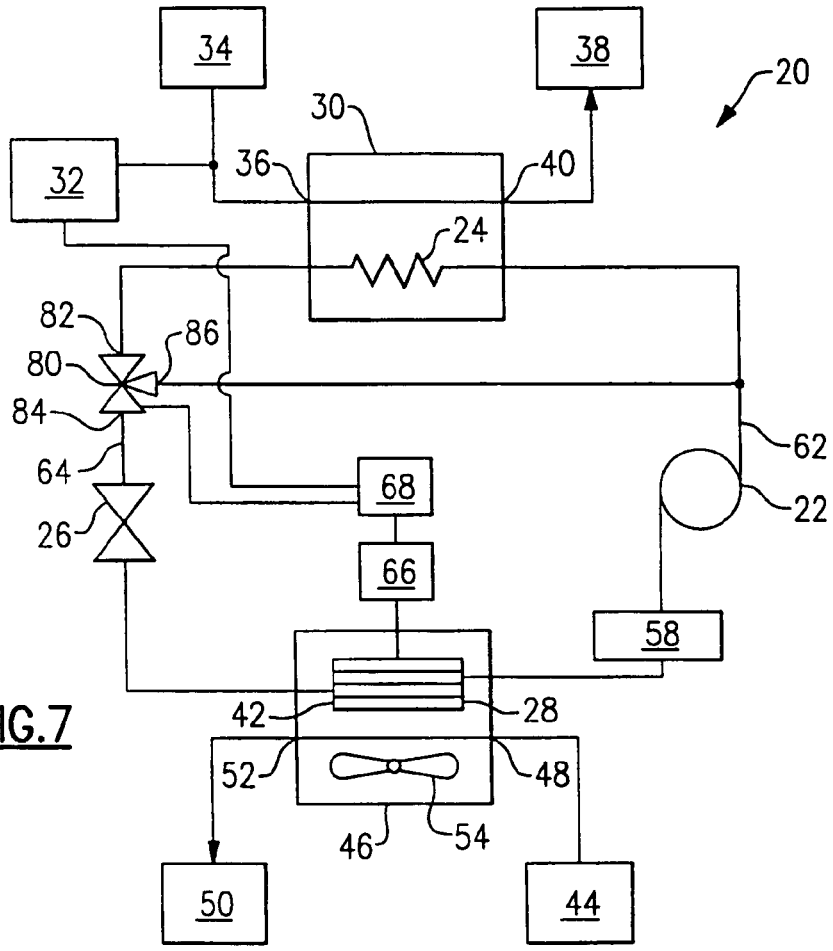
FIG. 7 schematically illustrates a fifth example vapor compression system of the present invention.

FIG. 7 schematically illustrates an alternate example of the system 20 of the present invention. The system 20 further includes a three-way valve 80 positioned between the gas cooler 24, the expansion device 26, and the discharge 62 of the compressor 22. The valve 80 includes a port 82 leading to the gas cooler 24, a port 84 leading to the inlet 64 of the expansion device 26, and a port 86 leading to the discharge 62 of the compressor 22. When the sensor 66 detects a condition that necessitates defrosting, the control 68 opens the port 86 and closes the port 82, preventing refrigerant from the gas cooler 24 from entering the expansion device 26. When the sensor 66 detects that frosting is no longer necessary, the control 68 closes the port 86 and opens the port 82, allowing refrigerant from the gas cooler 24 to enter the expansion device 26.

Figure 8:
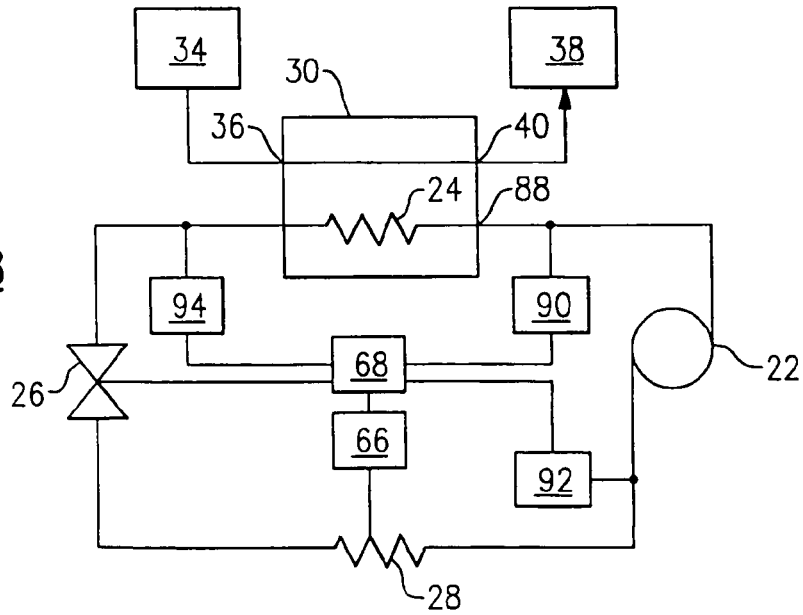
FIG. 8 schematically illustrates additional sensors that can be employed in the system.

As shown in FIG. 8, the orifice size of the expansion device 26 can be adjusted to control various characteristics of the vapor compression system 20. In one example, a sensor 90 senses the temperature of the refrigerant entering the gas cooler 24 through an inlet 88. If the refrigerant temperature at the inlet 88 of the gas cooler 24 exceeds a threshold value, the control 68 adjusts the orifice size of the expansion device 26. In one example, the threshold value is 212° F. Alternately, a sensor 92 senses the power of the compressor 22. If the compressor 22 power exceeds a threshold value, the control 68 adjusts the orifice size of the expansion device 26. Finally, a sensor 94 senses the high side pressure of the vapor compressor system 20. If the high side pressure exceeds a threshold value, the control 68 adjusts the orifice size of the expansion device 26.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A vapor compression system comprising:

a compression device to compress a refrigerant to a high pressure, said compression device including a discharge;

a heat rejecting heat exchanger for cooling said refrigerant;

an expansion device for reducing said refrigerant to a low pressure, said expansion device including an inlet;

a heat accepting heat exchanger for evaporating said refrigerant;

a refrigerant line bypassing said heat rejecting heat exchanger between said discharge of said compression device and said inlet of said expansion device, wherein said refrigerant in said refrigerant line flows directly from said discharge of said compression device and into said inlet of said expansion device;

a valve located on said refrigerant line to control a flow of said refrigerant between said discharge of said compression device and said inlet of said expansion device;

a sensor that detects a defrosting condition of said heat accepting heat exchanger; and a control that opens said valve when said sensor detects said defrosting condition to allow said refrigerant to flow through said valve.

2. The system as recited in claim 1 wherein said refrigerant from said compression device bypasses said heat rejecting heat exchanger, flows through said valve, flows through said expansion device, and flows through heat accepting heat exchanger to melt frost on said heat accepting heat exchanger when said valve is open.

3. The system as recited in claim 1 wherein said control closes said valve when said sensor does not detect said defrosting condition to prevent said refrigerant from flowing through said valve.

4. The system as recited in claim 1 further including a pump that draws a fluid through said heat rejecting heat exchanger, and said fluid exchanges heat with said refrigerant flowing through said heat rejecting heat exchanger.

5. The system as recited in claim 4 wherein said fluid is water.

6. The system as recited in claim 4 wherein said control deactivates said pump to stop said fluid from flowing through said heat rejecting heat exchanger when said control opens said valve to allow said refrigerant to flow through said valve.

7. The system as recited in claim 1 wherein said refrigerant is carbon dioxide.

8. The system as recited in claim 1 further including a second valve positioned between said discharge of said compression device and said heat rejecting heat exchanger, and said control closes said second valve when said sensor detects said defrosting condition to prevent said refrigerant from flowing through said second valve.

9. The system as recited in claim 1 further including a second valve positioned between said gas cooler and said inlet of said expansion device, and said control closes said second valve when said sensor detects said defrosting condition to prevent said refrigerant from flowing through said second valve.

10. The system as recited in claim 1 wherein said valve includes a first port in fluid communication with said discharge of said compression device, a second port in fluid communication with said heat rejecting heat exchanger, and a third port in fluid communication with said inlet of said expansion device, and said control closes said second port to prevent said refrigerant from said compression device from flowing through said heat rejecting heat exchanger and opens said third port to allow said refrigerant from said compression device to flow through said expansion device along said refrigerant line when said sensor detects said defrosting condition and said control opens said second port to allow said refrigerant from said compression device to flow through said heat rejecting heat exchanger and closes said third port to prevent said refrigerant from said compression device from flowing through said expansion device along said refrigerant line when said sensor does not detect said defrosting condition.

11. The system as recited in claim 1 wherein said expansion device includes an orifice, and said orifice is adjusted to control one of an inlet temperature of said refrigerant entering said heat rejecting heat exchanger, a power of said compression device, and said high pressure of said system.

12. The system as recited in claim 1 wherein said defrosting condition is frost.

13. The system as recited in claim 1 wherein said refrigerant in said refrigerant line bypasses an accumulator located between said heat accepting heat exchanger and said compression device.

14. The system as recited in claim 1 wherein said refrigerant in said heat accepting heat exchanger exchanges heat with air.

15. The system as recited in claim 1 wherein said refrigerant in said refrigerant line does not exchange heat in any component when directly flowing along said refrigerant line from said discharge of the compression device and into said inlet of said expansion device.

16. A vapor compression system comprising:

a compression device to compress a refrigerant to a high pressure, said compression device including a discharge;

a heat rejecting heat exchanger for cooling said refrigerant;

an expansion device for reducing said refrigerant to a low pressure, said expansion device including an inlet;

a heat accepting heat exchanger for evaporating said refrigerant;

a refrigerant line bypassing said heat rejecting heat exchanger between said discharge of said compression device and said inlet of said expansion device;

a valve located on said refrigerant line to control a flow of refrigerant between said discharge of said compression device and said inlet of said expansion device, wherein said valve includes a first port in fluid communication with said inlet of said expansion device, a second port in fluid communication with said heat rejecting heat exchanger, and a third port in fluid communication with said discharge of said compression device, and said control closes said second port to prevent said refrigerant from said heat rejecting heat exchanger from flowing through said expansion device and opens said third port to allow said refrigerant from said compression device to flow through said expansion device along said refrigerant line when said sensor detects said defrosting condition and said control opens said second port to allow said refrigerant from said heat rejecting heat exchanger to flow through said expansion device and closes said third port to prevent said refrigerant from said compression device from flowing through said expansion device along said refrigerant line when said sensor does not detect said defrosting condition;

a sensor that detects a defrosting condition of said heat accepting heat exchanger; and a control that opens said valve when said sensor detects said defrosting condition to allow said refrigerant to flow through said valve.

17. A method of regulating a high pressure of a transcritical vapor compression system comprising the steps of:

compressing a refrigerant to the high pressure in a compression device including a discharge;

cooling the refrigerant by exchanging heat with a fluid, and the fluid accepts heat from the refrigerant;

expanding the refrigerant to a low pressure in an expansion device including inlet;

evaporating the refrigerant in a heat accepting heat exchanger;

sensing a defrosting condition of the heat accepting heat exchanger;

directly flowing the refrigerant along a refrigerant line from the discharge of the compression device to the inlet of the expansion device; and melting frost on the heat accepting heat exchanger when the step of sensing the defrosting condition indicates the defrosting condition is necessary.

18. The method as recited in claim 17 further including the steps of sensing no frost on the heat accepting heat exchanger and blocking the flow of refrigerant from the compression device to the expansion device.

19. The method as recited in claim 17 wherein the refrigerant is carbon dioxide.

20. The method as recited in claim 17 wherein the step of directly flowing said refrigerant along the refrigerant line flows said refrigerant around an accumulator located between the heat accepting heat exchanger and the compression device.

21. The method as recited in claim 17 wherein the step of directly flowing said refrigerant along said refrigerant line does not exchange heat in any component when directly flowing along the refrigerant line from the discharge of the compression device and into said inlet of said expansion device.

* * * * *